US007263415B2

(12) United States Patent
Mindel

(10) Patent No.: US 7,263,415 B2
(45) Date of Patent: Aug. 28, 2007

(54) ELECTRONIC DRAWBAR

(75) Inventor: Klaus Mindel, Affalterbach (DE)

(73) Assignee: Thales, Neuilly sur Seine (FR)

( * ) Notice: Subject to any disclaimer, the term of this patent is extended or adjusted under 35 U.S.C. 154(b) by 0 days.

(21) Appl. No.: 11/341,609

(22) Filed: Jan. 30, 2006

(65) Prior Publication Data

US 2006/0129287 A1 Jun. 15, 2006

Related U.S. Application Data

(62) Division of application No. 10/635,618, filed on Aug. 7, 2003, now Pat. No. 7,027,899.

(30) Foreign Application Priority Data

Aug. 12, 2002 (EP) ..... 02360240

(51) Int. Cl.
*B60F 7/00* (2006.01)

(52) U.S. Cl. ..... 701/19; 213/1.3; 701/36; 701/300

(58) Field of Classification Search ..... 701/1, 701/23, 24, 36, 117, 118, 119, 25, 26, 300, 701/301; 180/167–179; 213/1–3
See application file for complete search history.

(56) References Cited

U.S. PATENT DOCUMENTS 5,697,583 A 12/1997 Kane
6,169,954 B1 1/2001 McCrary
6,198,994 B1 3/2001 McCrary
6,249,724 B1 6/2001 McCrary
6,276,542 B1 8/2001 McCrary
6,289,247 B1 9/2001 Faltys et al.
6,721,985 B2 4/2004 McCrary

FOREIGN PATENT DOCUMENTS

DE 198 28 878 A1 12/1999
FR 2 572 043 A1 4/1986

OTHER PUBLICATIONS

Patent Abstracts of Japan, vol. 16, No. 519 (M-1330), Oct. 26, 1992 & JP 04 191134 A (Toshiba Corp; Others: 01) Jul. 9, 1992.

*Primary Examiner*—Richard M. Camby
(74) *Attorney, Agent, or Firm*—Sughrue Mion PLLC

(57) ABSTRACT

To minimize headways between trains at stops in short-distance rail transport systems, an electronic drawbar is proposed which makes it possible to cause a following train to approach a train ahead up to a few meters and to follow at this distance in an electronically coupled mode. A method for carrying out the invention is wherein a rail vehicle with zero speed or with a speed below a predetermined minimum speed transmits a message which contains propulsion and braking control information or ready signals for activating an electronic drawbar for a following rail vehicle, and that after reception of the message from the rail vehicle ahead, the following rail vehicle approaches the rail vehicle ahead up to a predetermined distance.

4 Claims, 1 Drawing Sheet

ELECTRONIC DRAWBAR

CROSS REFERENCE TO RELATED APPLICATIONS

This is a divisional of application Ser. No. 10/635,618 filed Aug. 7, 2003 now U.S. Pat. No. 7,027,899. The entire disclosure of the prior application, application Ser. No. 10/635,618 is hereby incorporated by reference.

TECHNICAL FIELD

This invention relates to a method of electronically coupling rail vehicles in stop areas in short-distance rail transport systems.

The invention is based on a priority application EP 02360240.2, which is hereby incorporated by reference.

BACKGROUND OF THE INVENTION

In short-distance rail transport, stringent requirements are placed on headways between trains. Particularly at stops, such as platforms of subway stations, the requirements are difficult to meet. By running trains with the absolute stopping distance spacing (moving block) and by using short blocks, conventional systems try to minimize the headways. Typical values for the headway between trains range between one and two minutes; this includes a stopping time of typically 0.5 minutes. The main variable that can be influenced is the time required for a train following a stopping or moving train to travel from the entry signal to the stopping point at the platform. Conventional methods leave a distance between the two trains which includes at least the braking distance of the following train and a safety distance.

SUMMARY OF THE INVENTION

It is an object of the invention to minimize headways between trains at stops in short-distance rail transport systems.

This object is attained by an electronic drawbar which makes it possible to cause a following train to approach a train ahead up to a few meters and to follow the latter at this distance in an electronically coupled mode.

The implementation of the electronic drawbar only requires investments where they are necessary, namely at stops, where the headway between trains is not sufficient.

With the electronic drawbar, a time saving of approx. 10 seconds is possible compared to travel with the absolute stopping distance spacing. The headway between trains is thus reduced significantly, e.g. from 1 minute to 50 seconds, which corresponds to a time saving of approx. 17%.

The headway reduction particularly expedites the dissolution of a congestion caused, for instance, by a traffic disturbance.

The electronic drawbar can be retrofitted; its subsequent implementation in an existing infrastructure is possible in a simple manner. Depending on the equipment carried on the trains, implementation may be possible by means of a computer program which performs the specific functions for the activation and deactivation of the electronic drawbar. This is particularly advantageous if the number of passengers has increased, since the resulting longer stopping times can be compensated for by the time saving provided by the electronic drawbar.

The risk of a rear-end collision is very small. Even if such a collision should occur, the damage to be expected will be very small because of the low impact speed.

The electronic drawbar is implemented with train-carried apparatus and, hence, is a decentralized system. The decentralized system has significantly shorter response times than a central system. The trains communicate with each other directly without interposition of a center, and are thus closely coupled in time.

The method according to the invention for electronically coupling rail vehicles in stop areas in short-distance rail transport systems, and thus for implementing an electronic drawbar, is particularly characterized in that a rail vehicle with zero speed or with a speed below a predetermined minimum speed transmits a message which contains propulsion and braking control information or ready signals for activating an electronic drawbar for a following rail vehicle, and that after reception of the message from the rail vehicle ahead, the following rail vehicle approaches the rail vehicle ahead up to a predetermined distance (S).

When a rail vehicle, e.g., an urban railway vehicle or a subway vehicle, stops at a station platform, a following vehicle can approach the stopping vehicle up to a few meters. When the vehicle ahead detects a stand of the train, e.g. by evaluating the tachometer, a message ("telegram") will be automatically generated and transmitted. The transmission takes place via continuous track conductors, for example, which are also laid in the area of a following rail vehicle. The following rail vehicle will detect the message via the track conductor, reduce its speed to a few km/h, and approach the vehicle ahead up to a few meters. The message contains, for instance, ready signals for activating the electronic drawbar. The following rail vehicle communicates, e.g., via the track conductor, with the vehicle ahead for the purpose of coordinating the activation and locking of the electronic drawbar. Communication takes place as follows, for example. The train ahead stops and transmits ready signals for activating the electronic drawbar. The following train detects the ready signals and sends signals to the train ahead which indicate its readiness for activation. The train ahead receives these signals and sends request signals to the following train. By means of these signals, the following train is requested to inform the train ahead when it has reached the predetermined distance. The following train transmits response signals which indicate that the distance has been reached. After receipt of the response signals, the train ahead transmits propulsion and brake control information. The following train receives the control information and controls itself by means of this information. As soon as the train ahead starts to move, the following trains starts to move under the same propulsion control, with the same acceleration, with the same speed, and at the same time as the train ahead. At this time, the two trains are linked by a virtual drawbar and, with respect to propulsion, behave like a single train. When the train ahead brakes, the following train brakes nearly at the same time. Only a safety distance of a few meters is maintained between the two trains. The distance is 5 to 20 meters, for example.

Alternatively, communication takes place as follows, for example. The train ahead stops and transmits propulsion and braking control information. The following train detects the control information and then approaches the train ahead up to the predetermined distance. Upon reaching the distance, it automatically switches to remote control of the following train by the train ahead. Thus, as soon as the distance is reached, the train ahead takes over the propulsion of the following train. In this alternative, no bidirectional communication is necessary between the following train and the train ahead.

To further minimize headways between trains, it is advantageous, particularly with a high traffic volume, if the train ahead is already transmitting messages while entering a station and before coming to a stop. Messages are transmitted, for example, as soon as the speed of the train ahead is below a predetermined minimum speed. Advantageously, the messages are not transmitted until an entry signal for the station is received and the zone in which track conductors were laid is reached.

The zone in which track conductors were laid extends, for instance, from the entry signal point to the exit signal point. Alternatively, it extends to an area in front of the entry signal point. In a further variant, it also extends to an area behind the exit signal point. The location of the area also depends on the point on the trains where the apparatus for carrying out the method is mounted.

Instead of track conductors, radio can be used. The train ahead and the following train communicate via Bluetooth or wireless LAN, for example; LAN=Local Area Network.

A preferred embodiment of the method is characterized in that after approaching the rail vehicle ahead up to the predetermined distance, the following rail vehicle is operated by means of the propulsion and braking control information received from the rail vehicle ahead.

An apparatus according to the invention for electronically coupling rail vehicles in stop areas in short-distance rail transport systems, and thus for implementing an electronic drawbar, is characterized in that a control unit and a transceiver unit are provided which are interconnected, and that the control unit is designed to determine the speed of a rail vehicle and, if the speed is zero or below a predetermined minimum speed, to control the transceiver unit in such a way as to transmit a message which contains propulsion and braking control information or ready signals for activating an electronic drawbar for a following rail vehicle. The apparatus is implemented on the rail vehicle ahead. Viewed in the direction of travel, it is mounted, for example, in the front or rear part of the vehicle. The apparatus may also form part of existing equipment for controlling the train. The control unit is, for instance, a processor with a memory and a specific software program. Instead of one processor, such as a microprocessor, digital signal processor, or controller, two or more processors may be present. Instead of one memory, such as a RAM, two or more memories may be present. Instead of one software program (=computer program), two or more such programs may be present. A software program may also consist of two or more software packages which are stored on and invoked by means of different pieces of hardware. The transceiver unit is, for instance, a unit for transmitting and receiving signals for a track conductor or radio signals.

A preferred embodiment of the apparatus is characterized in that a distance sensor is provided which is connected to the control unit, that the distance sensor is arranged and designed to measure the distance to a following rail vehicle and to transfer the measurement result to the control unit, and that the control unit is designed to compare the measurement result with a maximum value and to stop the transmission of the message if the measurement result exceeds the maximum value. The distance sensor is mounted on the train ahead at the rear. It determines the distance to the following train. When the train ahead leaves the station, the following train automatically interrupts the connection to the train ahead as soon as the following train has arrived in the platform area and must initiate braking to come to a stop. As a result, the distance to the train ahead will increase, so that the train ahead can stop the transmission of the messages, since these are no longer needed.

Another preferred embodiment of the apparatus is characterized in that a distance sensor is provided which is connected to the control unit, that the distance sensor is arranged and designed to measure the distance to a following rail vehicle and to transfer the measurement result to the control unit, and that the control unit is designed to compare the measurement result with a minimum value or with a predetermined or communicated distance and to stop the transmission of the message if the measurement result is less than the minimum value or not equal to the distance. The distance sensor is mounted on the train ahead at the rear. It determines the distance to the following train. If the following train does not maintain the predetermined distance, the transmission of the messages is stopped, which results in the electronic drawbar being unlocked and the following train running on its own again. Prior to the stopping, the following train is warned and called upon to initiate a braking process. Insofar, the use of the distance sensor increases the safety of the electronic drawbar.

A further preferred embodiment of the apparatus is characterized in that the transceiver unit is designed to transfer a received platform exit signal or information on the reception of this signal to the control unit, and that the control unit is designed to stop the transmission of the message after reception of the platform exit signal or of the information thereon. After the train ahead has left the station, the following train has already entered the platform area, so that at a given point in time, a deactivation of the electronic drawbar must be effected to enable the following train to brake and stop at the platform. One possibility is to use the exit signal as a switching signal for stopping the messages and, thus, for automatically unlocking the electronic drawbar. When the following train no longer receives messages, it switches immediately to the self-controlled mode of operation and initiates a braking process.

A still further embodiment of the apparatus is characterized in that the transceiver unit is designed to transfer a received platform entry signal or information on the reception of this signal to the control unit, and that the control unit is so designed that after reception of the platform entry signal or the information thereon and if a zero speed was determined, it controls the transceiver unit to transmit a message which contains propulsion and braking control information or ready signals for activating an electronic drawbar for the other rail vehicle. The instant of transmission of the messages can be combined with the speed of the train ahead and the reception of the platform entry signal. After receipt of the entry signal, the train ahead knows that it is in the station area, and can transmit messages at an early time so as to enable a following train to activate the electronic drawbar as early as possible.

Yet another embodiment of the apparatus is characterized in that the transceiver unit is designed to transfer a message received from the following rail vehicle or information on the reception of this message to the control unit, and that the control unit is so designed that after reception of the message from the following rail vehicle or of the information thereon and if a zero speed or a speed below a predetermined minimum speed was determined, it controls the transceiver unit to transmit a message which contains propulsion and braking control information for the other rail vehicle. In this embodiment, bidirectional communication takes place between the train ahead and the following train before the control data is transmitted.

A further apparatus according to the invention for electronically coupling rail vehicles in stop areas in short-distance rail transport systems is characterized in that a control unit and a transceiver unit are provided which are interconnected, that the transceiver unit is designed to transfer a message received from a rail vehicle ahead or information on the reception of this message to the control unit, and that the control unit is so designed that after reception of the message from the rail vehicle ahead or of the information thereon, it controls the following rail vehicle in such a way that it approaches the rail vehicle ahead up to a predetermined distance. This apparatus is implemented on the following rail vehicle and, as viewed in the direction of travel, is mounted at the front or at the rear, for example. It may also form part of existing equipment for controlling the train. The control unit is, for instance, a processor with a memory and a specific software program. Instead of one processor, e.g., a microprocessor, digital signal processor, or controller, two or more processors may be present. Instead of one memory, e.g., a RAM, two or more memories may be present. Instead of one software program (=computer program), two or more may be present. A software program may also consist of two or more software packages that are stored on and invoked by means of different pieces of hardware. The transceiver unit is, for instance, a unit for transmitting and receiving signals for a track conductor or radio signals.

A preferred embodiment of the further apparatus is characterized in that the control unit is so designed that after reception of the message from the rail vehicle ahead or of the information thereon, it controls the transceiver unit to transmit a message which contains ready signals for activating an electronic drawbar for the rail vehicle ahead. Prior to the activation, communication takes place between the rail vehicles for the purpose of exchanging data that are necessary for activation. For instance, the following rail vehicle transmits to the vehicle ahead data about its current speed, its train number, its current location, or the like. After evaluation, the rail vehicle ahead transmits to the following rail vehicle a permission to activate the electronic drawbar, for example.

Another preferred embodiment of the further apparatus is characterized in that a distance sensor is provided which is connected to the control unit, that the distance sensor is arranged and designed to measure the distance to the rail vehicle ahead and to transfer the measurement result to the control unit, and that the control unit is designed to compare the measurement result with a minimum value or a predetermined distance and to control the rail vehicle in such a way that it approaches the rail vehicle ahead up to the minimum value or the predetermined distance at the most. By means of the distance sensor, the distance to the rail vehicle ahead can be determined in a simple manner. Instead of one distance sensor, two or more distance sensors can be used to enhance safety.

A further preferred embodiment of the further apparatus is characterized in that the transceiver unit is designed to transfer a message received from the rail vehicle ahead, containing propulsion and braking control information, to the control unit, and that the control unit is so designed that after reception of the message from the rail vehicle ahead and after the approach to the rail vehicle ahead up to the predetermined distance, it controls the rail vehicle in such a way that it is operated by means of the propulsion and braking control information received from the rail vehicle ahead. The two rail vehicles are then operated synchronously by the control unit of the rail vehicle ahead.

Depending on the equipment carried on the trains, implementation by means of a computer program may be possible.

A computer program according to the invention for a control unit for electronically coupling rail vehicles in stop area in short-distance rail transport systems and for use in a rail vehicle ahead is characterized in that at zero speed or at a speed below a predetermined minimum speed, a message is generated which contains propulsion and braking control information or ready signals for activating an electronic drawbar for a following rail vehicle. The computer program is implemented on the rail vehicle ahead.

Another computer program according to the invention for a control unit for electronically coupling rail vehicles in stop areas in short-distance rail transport systems and for use in a following rail vehicle is characterized in that upon reception of a message from a rail vehicle ahead, containing propulsion and braking control information or ready signals for activating an electronic drawbar, control signals are generated for controlling the following rail vehicle in such a way that it approaches the rail vehicle ahead up to a predetermined distance. The computer program is implemented on the following rail vehicle.

Both computer programs can be implemented on one and the same rail vehicle using one and the same control unit or two or more control units. The rail vehicle is thus capable of acting both as a vehicle ahead and as a following vehicle. It is also cost-saving to provide only one transceiver unit per train which can then be used both for reception in the case of a following rail vehicle and for transmission in the case of a rail vehicle ahead.

BRIEF DESCRIPTION OF THE DRAWINGS

The invention will become more apparent by reference to the following description of an embodiment taken in conjunction with the accompanying drawing, in which.

BEST MODE FOR CARRYING OUT THE INVENTION

Figure 1:
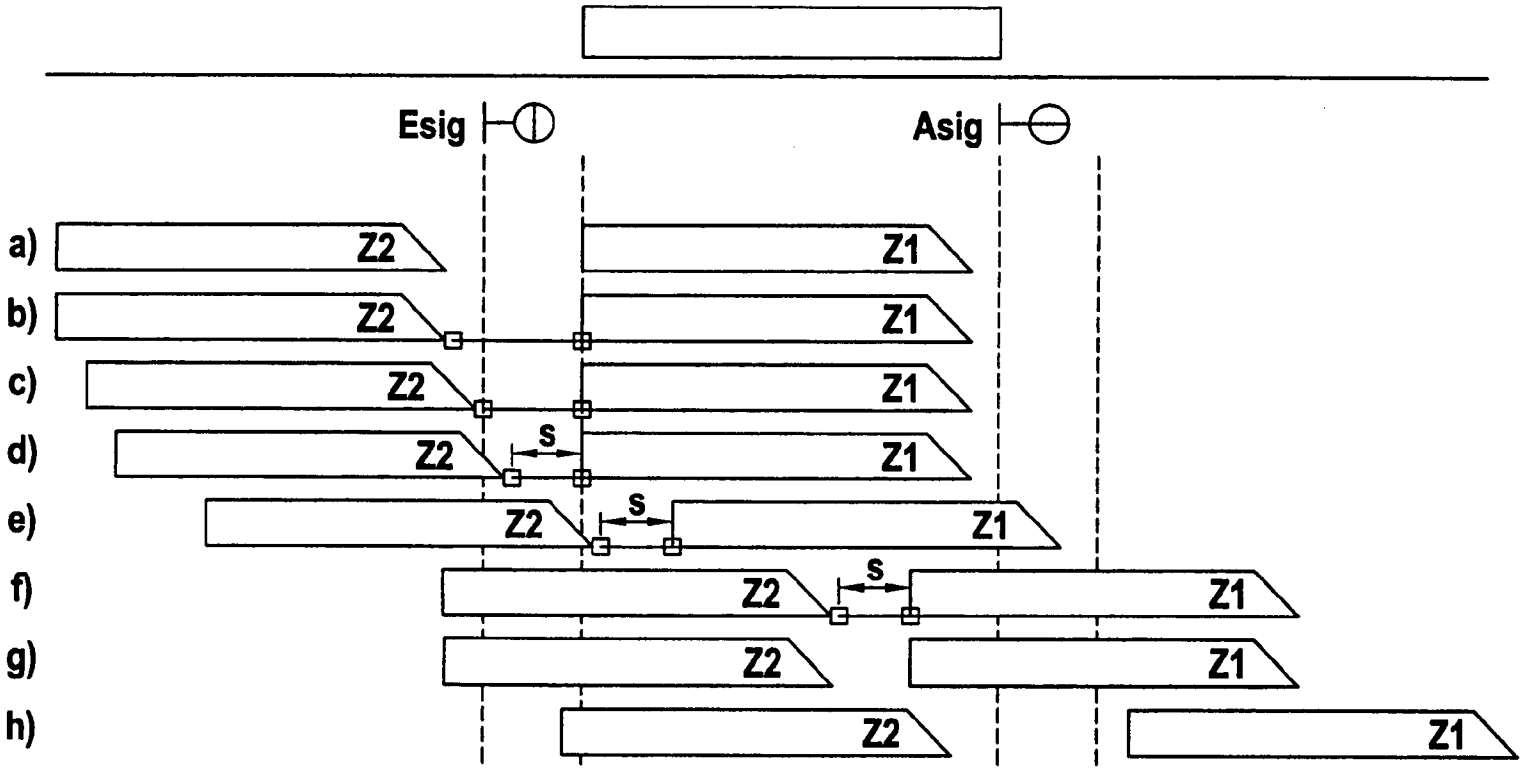
FIG. 1 is a schematic representation of an operational sequence according to the invention for electronically coupling two trains in a stop area.

Referring first to FIG. 1, there is shown the operational sequence for electronically coupling two trains in a stop area.

The situation at a station stop is considered. The section at the platform is bounded by the entry signal Esig and the exit signal Asig. To optimize the headway between trains, the distance between the train ahead, Z1, and the following train, Z2, has to be minimized.

In a first time period a), train Z1 has already entered the station, has stopped at the platform, and is transmitting messages. Train Z2 is approaching the station and is braking because the entry signal Esig is red, i.e., at stop.

In a second time period b), train Z2 is receiving the messages from train Z1 and, in response thereto, activates the electronic drawbar. Train Z2 is now permitted to proceed at slow speed. The distance sensor on train Z2 and a specific computer program are activated which monitor the measured distance to train Z1. Instead of using a distance sensor on train Z2, the latter may be permitted to proceed up to a second entry signal directly in front of the platform if the message transmitted by train Z1 contains information saying, for example, that train Z1 has already stopped at the platform as prescribed and, thus, does not extend into the entry area. Train Z2 proceeds at reduced speed up to the second entry signal knowing that train Z1 is already standing at the platform, so that the track to the platform is clear.

The second entry signal then specifies a minimum value for the approach to train Z1.

In a third time period c), train Z2 is moving closer to train Z1.

In a fourth time period d), train Z2 has reached the predetermined distance S, which may also be referred to as the minimum distance, or the minimum value. Now the electronic drawbar is locked. Thus, virtual coupling of train Z2 to train Z1 has been effected; no mechanical coupling takes place. This means that from now on, train Z2 is controlled by train Z1. The two trains behave like a single train. They are linked by a virtual drawbar. As soon as train Z1 starts to move, train Z2 also starts to move, because it is controlled by the same control signals. The distance between the two trains is maintained constant.

In a fifth time period e), train Z1 is beginning to leave the station. Train Z2 is following train Z1 at the distance S.

In a sixth time period f), train Z1 continues to pull out. Train Z2 continues to follow train Z1 at the distance S. Train Z2 is already in the platform area.

In a seventh time period g), train Z2 reaches the brake application point for the stop. The information about the brake application point is communicated to train Z2 via the track conductor, for example. The transceiver unit of train Z2 is capable of operating in multicast mode, i.e., of receiving control signals from train Z1 and, simultaneously or within the scope of the time-division multiplex, brake application point signals. After receipt of the brake application point signals, the electronic drawbar is unlocked in train Z2 and braking is initiated. The unlocking of the electronic drawbar may also be referred to as deactivation. Train Z2 again has control over its operation. Train Z1 is proceeding uninfluenced. Even during operation of the electronic drawbar and after the locking, it is possible for train Z2 to intervene independently in its own operation. For instance, distance sensor continues to determine the distance to the train ahead, Z1, and if the distance is less than the distance S, braking is initiated independently and automatically. Optionally, switchover to manual operation is possible.

In a preferred embodiment, in order to enhance safety, the zone in which track conductors are laid is so designed that messages from train Z1 to train Z2 can no longer reach train Z2 shortly after the brake application point at the latest, because train Z1 is already outside that zone. In this way, the electronic drawbar is interrupted up to a predetermined instant in a controlled mode, and thus deactivated. With the electronic drawbar deactivated, train Z2 immediately initiates braking, whereupon it comes to a stop at the platform.

In an eighth time period h), the distance between train Z1 and Z2 increases as train Z2 is braking and train Z1 continues to accelerate. Train Z1 has already left the platform. Train Z2 has stopped as prescribed.

For a train following train Z2, the operational sequence is predetermined by time periods a) to h). Train Z2 then becomes the train ahead. If train Z2 should have left the platform before the following train approaches the station, the following train will enter the station normally and without the electronic drawbar. Accordingly, the electronic drawbar is activated only if required. However, the timetable may also be so designed that during rush-hour periods, for example, the headway between trains is chosen to be so short that the electronic drawbar will, as a rule, be activated and locked for each entering train.

Instead of electronically coupling only two trains, more than two trains, e.g., three or four, may be electronically coupled. A train ahead will then control two or more following trains via messages, with each train maintaining a distance S to the respective train ahead.

Figure 2:
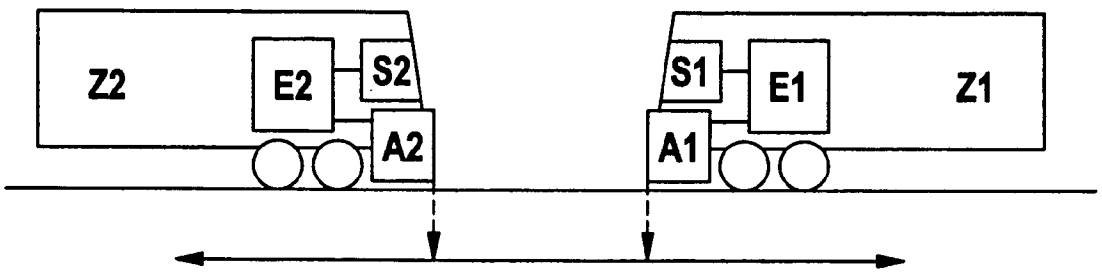
FIG. 2 is a schematic representation of a setup of technical apparatus for carrying out the electronic coupling according to FIG. 1.

The embodiment will now be further described with reference to FIG. 2. FIG. 2 shows technical apparatus for carrying out the electronic coupling according to FIG. 1.

In a train ahead, Z1, a control unit E1, a distance sensor S1, and a transceiver unit A1 are mounted at the rear. In a following train, Z2, a control unit E2, a distance sensor S2, and a transceiver unit A2 are mounted at the front.

In a station area, a validity range is defined in which track conductors were laid and in which running with an electronic drawbar is permitted. The transceiver units A1 and A2 communicate with one another via the track conductors.

The operational sequence for activating and deactivating the electronic drawbar is as follows.

Train Z1 stops at the platform. Control unit E1 detects a train speed of zero and thereupon transmits messages via transceiver unit A1 into the track conductors.

Train Z2 receives the messages from train Z1 via the track conductors and transceiver unit A2, which transfers them to control unit E2. Control unit E2 determines the speed of train Z2. If the speed is less than a predetermined limit speed, e.g., 5 to 20 km/h, activation of the electronic drawbar is permitted. Control unit E2 initiates the activation and controls train Z2 in such a manner that it draws closer to train Z1. During this approach, control unit E2 activates distance sensor S2 for determining the distance to train Z1. Train Z2 approaches train Z1 up to a predetermined distance S at a speed not exceeding the limit speed. Then, the electronic drawbar is locked. To enhance signaling safety, distance sensor S1 can be used prior to the locking to verify measurements of distance sensor S2.

After a stopping time, train Z1 leaves the platform and pulls out of the station. At this time, the electronic drawbar is locked and control unit E1 has access to the propulsion and braking control of train Z2 via transceiver unit A1, the track conductors, and transceiver unit A2. Via this access, control unit E1 causes trains Z1 and Z2 to run synchronously, i.e., train Z2 starts nearly simultaneously with, and with the same acceleration as, train Z1 and follows the latter at the distance S.

When train Z1 leaves the track-conductor area, and thus the validity range, control unit E2 ceases receiving messages and control unit E1 no longer has access to train Z2. At this instant at the latest, an application of the service brake of train Z2 is initiated. Train Z2 brakes and comes to a stop at the platform.

Apparatus for an electronic drawbar may comprise a control unit E1, a distance sensor S1, and a transceiver unit A1 as well as a control unit E2, a distance sensor S2, and a transceiver unit A2. The functionalities of control units E1 and E2 may also be combined in one control unit. The functionalities of transceiver units A1 and A2 may also be combined in one transceiver unit. Instead of two distance sensors S1 and S2, which are used, e.g. simultaneously, to determine the distance to the train ahead, only a single distance sensor may be used; two distance sensors increase safety, however. Such apparatus for an electronic drawbar is capable of controlling the activation and deactivation of the electronic drawbar for both a train ahead and a following train. Viewed in the direction of travel, the apparatus is mounted at the front, for example. Ideally, the apparatus forms part of existing equipment of a motive power unit. This facilitates, and reduces the cost of, the upgrading of motive power units. A train usually has one motive power unit at its head and another at its end so as to permit movement in both directions of. If both motive power units of a train are equipped with apparatus for an electronic drawbar or with the functionality of such an electronic drawbar, the train can be operated with the electronic drawbar in both directions of travel.

The invention claimed is:

1. A method of electronically coupling rail vehicles in stop areas of in short-distance rail transport systems, wherein a rail vehicle with zero speed or with a speed below a predetermined minimum speed transmits a message which contains propulsion and braking control information or ready signals for activating an electronic drawbar for a following rail vehicle, and that after reception of the message from the rail vehicle ahead, the following rail vehicle approaches the rail vehicle ahead up to a predetermined distance.

2. A method as set forth in claim 1, wherein after approaching the rail vehicle ahead up to the predetermined distance, the following rail vehicle is operated by means of the propulsion and braking control information received from the rail vehicle ahead.

3. A computer program for a control unit embodied on a computer readable medium for electronically coupling rail vehicles in stop areas in short-distance rail transport systems, wherein at zero speed or at a speed below a predetermined minimum speed, a message is generated by a rail vehicle which contains propulsion and braking control information or ready signals for activating an electronic drawbar for a following rail vehicle.

4. A computer program for a control unit embodied on a computer readable medium for electronically coupling rail vehicle in stop areas in short-distance rail transport systems, wherein upon reception of a message from a rail vehicle ahead, containing propulsion and braking control information or ready signals for activating an electronic drawbar, control signals are generated for controlling the following rail vehicle in such a way that it approaches the rail vehicle ahead up to a predetermined distance.

* * * * *